US006053805A

United States Patent [19]

Sanchez

[11] Patent Number: 6,053,805

[45] Date of Patent: Apr. 25, 2000

[54] DUST FREE SANDER

[75] Inventor: Angelo Sanchez, 25 Pippen Pl., New City, N.Y. 10956

[73] Assignee: Angelo Sanchez, Nanuet, N.Y.

[21] Appl. No.: 09/157,049

[22] Filed: Sep. 18, 1998

Related U.S. Application Data

[63] Continuation-in-part of application No. 08/838,830, Apr. 10, 1997, abandoned.

[51] Int. Cl.[7] ..... B24B 23/00; B24B 55/10

[52] U.S. Cl. ..... 451/456; 451/354

[58] Field of Search ..... 451/456, 354, 451/356, 344, 453, 524, 525

[56] References Cited

U.S. PATENT DOCUMENTS

| | | | |
|---|---|---|---|
| 2,711,059 | 6/1955 | Ames | 451/525 |
| 4,062,152 | 12/1977 | Mehrer | 451/456 |
| 4,517,700 | 5/1985 | Pinto | 451/524 |
| 4,779,385 | 10/1988 | Reiter | 451/456 |
| 4,964,243 | 10/1990 | Reiter | 451/354 |
| 5,036,627 | 8/1991 | Walters | 451/524 |
| 5,527,212 | 6/1996 | Bowen et al. | 451/356 |
| 5,624,305 | 4/1997 | Brown | 451/354 |
| 5,895,316 | 4/1999 | Williams | 451/524 |

FOREIGN PATENT DOCUMENTS

| | | | |
|---|---|---|---|
| 2051514 | 3/1993 | Canada | 451/354 |

*Primary Examiner*—Robert A. Rose
*Attorney, Agent, or Firm*—Graham & James LLP

[57] ABSTRACT

A dust free sanding device, such as for use in sanding wallboards, having a sanding block element and an elongated handle attached to the block element with a rotating swivel hinge which handle is variably movable in a full 360° arc and hingedly swivelable, in a direction normal thereto, in a 180° arc. The handle is a hollow cored cylinder with open ends. The block element is apertured at its connection with the swivel hinge and the swivel hinge is centrally apertured in registration with the aperture in the block element. A vacuum line is effected through the handle to the apertures in the swivel hinge and sanding block to provide suction for removal of sanding dust from beneath the sanding block during a sanding operation. Releasable spring loaded detente balls provide a positive position retention at desired positions.

7 Claims, 3 Drawing Sheets

DUST FREE SANDER

This is a continuation in part application of Ser. No. 08/838,830, filed Apr. 10, 1997 now abandoned.

FIELD OF THE INVENTION

This invention relates to dust free sanding devices and particularly to wallboard sanding devices.

BACKGROUND OF THE INVENTION

Dust free sanding devices are usually configured with vacuum hoses and/or directly integrated motor driven vacuums with connected bags, to suction away the dust generated during the sanding. Sanding devices used for the sanding and smoothing of wallboards during construction or renovations are generally configured in a pushbroom-like configuration with an elongated rod handle and a sanding block member, to which perforated sanding or rasping material, such as a sanding screen, is affixed, such as described in my U.S. Pat. No. 5,193,313, issued Mar. 16, 1993, the disclosure of which is incorporated herein by reference thereto. The base of the sanding block usually has recessed and raised sections to permit air flow therebetween for vacuum removal of sanding particle.

In devices which are connected to an external vacuum or suction source, such as described in the aforementioned patent, a common configuration is that of a vacuum tube, from the source, being drawn and attached alongside of the rod handle and through the sanding block member whereby it has suction access to the dust, e.g., gypsum powder, being generated with the sanding. In some configurations the handle is hollowed out for use as part of the vacuum conduit with one or more vacuum tubes extending from the handle to the sanding block member.

In use, the sanding tool with sanding screen is forcibly scraped or rasped against the surface to be smoothed, with generation of gypsum powder (or similar material), during "taping" or during removal of dirt, and even during paint removal to expose a fresh surface for application of a fresh coat of paint. For health reasons and to ensure a clean surface, the generated gypsum powder is removed, as it is created, by meals of the vacuum hook-up. However, the prior-art vacuum hook-up arrangements for removal of dust are generally awkward, with the real possibility of entanglement and/or difficulty in unrestricted movement of the sanding device and handle, thereby restricting the ability to properly sand an area efficiently.

SUMMARY OF THE INVENTION

It is therefore an object of the present invention to provide a dust free sanding device which is integrally compact and maneuverable.

It is a further object of the present invention to provide a dust free sanding device with unrestricted handle movement wherein the vacuum line includes the handle itself and directly therefrom through a rotating swiveling hinge element by which the handle is attached to the sanding block, whereby the handle is completely maneuverable for positioning in any direction relative to the sanding block, in a plane above the sanding block. The device further comprises releasable position locking in a selected position of the handle relative to the sanding block.

These and other objects, features and advantages of the present invention will become more evident from the following discussion and drawings in which:

SHORT DESCRIPTION OF THE DRAWINGS

Figure 8:
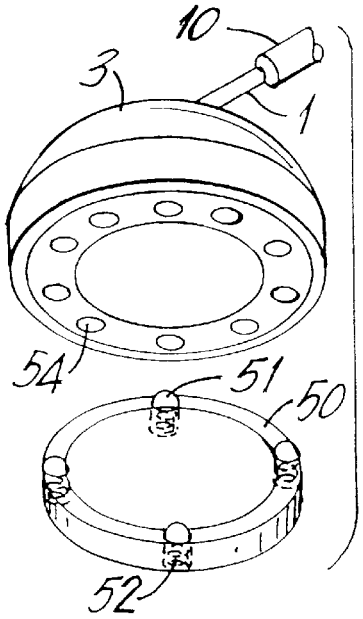
Figure 8A:
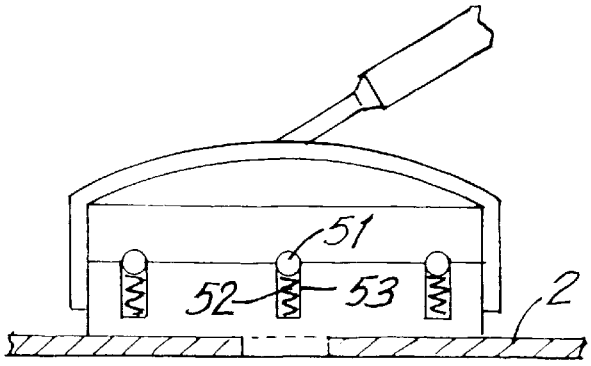

FIGS. 8 and 8*a* depict a detente ball/spring mechanism for maintaining the handle in a pre-selected position relative to the sanding block.

DETAILED DESCRIPTION OF THE INVENTION

Generally the present invention comprises a dust free sanding device comprised of a sanding block member having a preferably centrally located through-aperture extending from the upper to lower surfaces thereof and a hollow elongated rod handle movably connected thereto by rotatable, swiveling hinge means, and with vacuum drawing means contained within the hollow of the handle, and preferably comprised of the handle itself. The central aperture also may include or even replaced by other closely laterally adjacent apertures within the direct purview of the drawing vacuum.

The swiveling hinge means is apertured such that the aperture therethrough is in air-flow connection with both the centrally located aperture (and/or laterally adjacent apertures) of the sanding block and an open end of the handle adjacent thereto. The open end of the handle is directly attached to the swiveling hinge means, such as by hollow conduit means (e.g. a short pipe length). The swiveling hinge means are in turn contained within a rotatable, preferably dome-shaped member, in a slot therein with the handle and conduit means being hingeably moveable in essentially a 180° arc within the slot. The dome preferably comprises air/dust conduit(s) connected to the central aperture in the block and to the hinge means. The hinge means are preferably comprised of bosses which are adapted to be fitted into recess in the dome which are adapted to snugly accommodate the bosses while permitting them to rotate therewithin to permit the 180° hinging movement. The hinging bosses are hollow and are in registration with the air/dust conduit(s) of the dome member to permit airflow therethrough and into the handle. The dome with the slot permits hinging of the handle is hingeable in a 180° arc and the dome itself is rotatable in a 360° circle relative to the sanding block to which it is rotatably affixed.

As a result of such configurations, the handle can be swiveled in a complete 360° circle (around the sanding block) and, at each point of the circle, the handle is hingedly swivelable along a defined diameter of the circle. The dome which completes the vacuum connection between the handle and the sanding block, has an axis coincident with that of the handle (when perpendicular to the sanding block) and the apertures in the swiveling hinge member and the sanding block member. In addition, the dome is coincidentally rotatable with rotation of the swiveling hinge member and swiveling of the handle. This permits full swiveling movement of the handle, relative to the sanding block member, without impeding entanglements. The handle can thus be selectively positioned at any point above the sanding block.

The dome for the swiveling hinge means is preferably comprised of a two part circular members which rotatably move relative to each other. An example of such members comprises two opposed, attached circular track parts defining a centrally located opening and with the two opposed tracks being circularly movable relative to each other via roller bearings positioned therebetween. One track is fixed on the upper surface of the sanding member in a position peripheral to the aperture therein. The other track supports the hinge means to which the handle is affixed. Alternatively if the members are smoothly slidable relative to each other, or if a single member is contained within a circular recess in the upper surface of the sanding block and rotatable therein, roller bearings are not required.

In order to maintain the handle in a pre-selected position relative to the sanding block during use of the sanding block, and wherein the positions can be readily charged, it is preferred that the sanding block be provided with an interposed detente ball/spring mechanism ring comprised of spring loaded balls partially confined within respective cavities and partially outwardly extending in a normal unstressed mode. The base of the sphere which supports the handle is correspondingly provided with a plurality of shallow semi-spherical cavities for accommodating the portion of the balls which extend across the parting line between the sphere and the sanding block. Rotational movement is blocked by the respective balls spanning the parting line (the balls are preferably even and symmetrically placed for maximizing position selection and rotational movement blockage. Release of the blocking balls is effected by pushing of the dome toward the sanding block whereby the blocking balls are moved away from the parting line and into their respective cavities. As a result, the dome is rotatable even during continued use without necessity for stopping and release of locking elements.

DETAILED DESCRIPTION OF THE DRAWINGS AND THE PREFERRED EMBODIMENT

Figure 1:
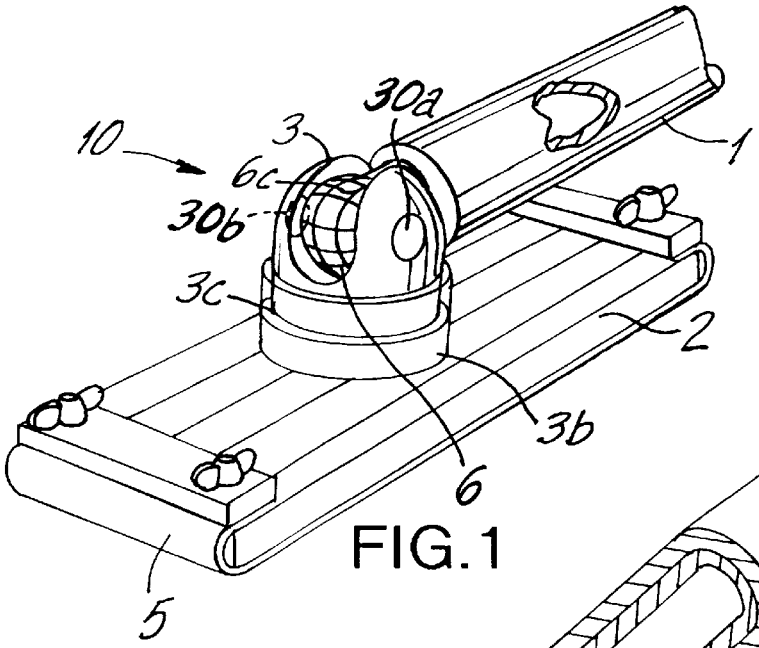
FIG. 1 is an isometric view of the dust free sanding device of the present invention.
Figure 2:
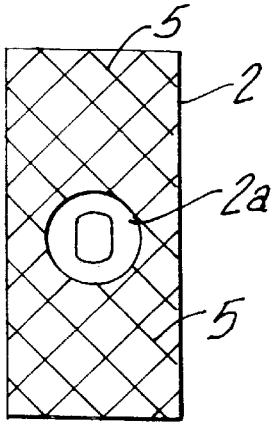
FIG. 2 is a bottom view of the sanding block used in the device shown in FIG. 1, showing the air channel passage.
Figure 3:
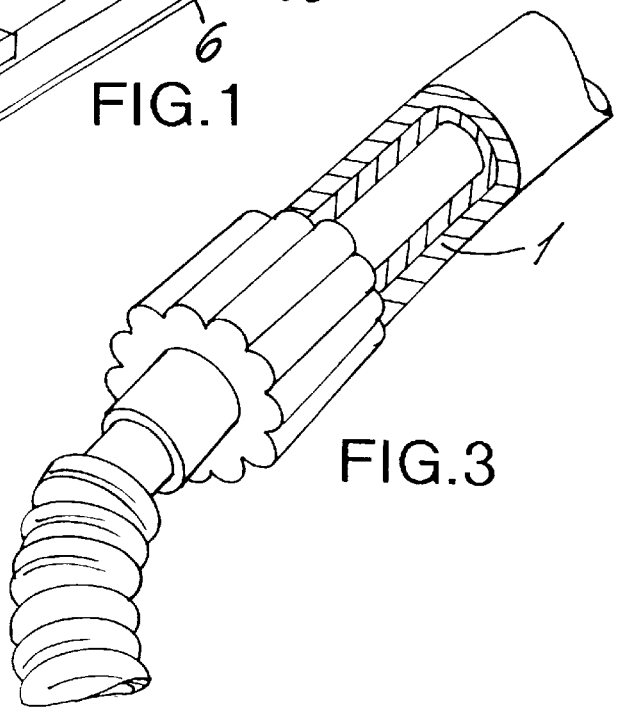
FIG. 3 is a partial sectioned view of the handle.
Figure 4:
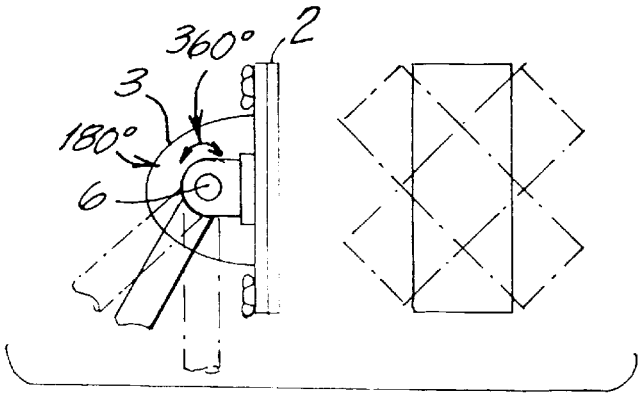
FIG. 4 is a view of the sanding block and swivel hinge with full variable motion and positioning, illustrated in phantom.

In FIG. 1, the sanding device 10 of the present invention is shown with hollow rod handle 1 hingedly affixed to sanding block 2 by means of rotatable dome member 3. The dome 3 is comprised of connected element 3*a* and 3*b* which are separated by roller bearings 3*c* and by means of which bearings, element 3*a* readily rotates relative to fixed element 3*b* (element 3*b* is affixed to the sanding block 2). Elements 3*a* and 3*b* are connected to aperture 4 in sanding block, by air conduits contained in the elements (more clearly visible in FIG. 5). As seen in FIG. 2, the sanding block 2 is through apertured and the sanding material 5 (e.g. sanding screen) affixed to the sanding block is inherently apertured. Hinging element 6 shown more clearly in FIG. 6*a* is attached to handle 1 via pipe 6*c* and integrally comprises hollow bosses 6*a* and 6*b* which fit into cofitting recesses 30*a* and 30*b* in rotatable dome element 3*a*. These bosses permit the handle 1, as shown in FIG. 4, to readily hingedly swivel in a 180° straight line across the upper surface of sanding block 2. In addition, rotation of element 3*a* relative to element 3*b* effects a 360° rotation parallel to the sanding block, as indicated by the arrow. The combination of hinge and rotational movements permits the handle to be readily positioned at any point above the sanding block. As a result, sanding operations may be more efficiently continuous without necessity for lifting and repositioning of the sanding block during use.

The vacuum line extends from a source (not shown), through the length of hollow handle 1, then via hinge member 6, dome member 3 and then aperture 2*a* in sanding block 2, whereby the vacuum is able to draw dust from beneath and peripherally next to the sanding block. Since the vacuum line, as described, is symmetrically axially aligned with the handle it does not impede any rotational movement of the handle during use.

Figure 5:
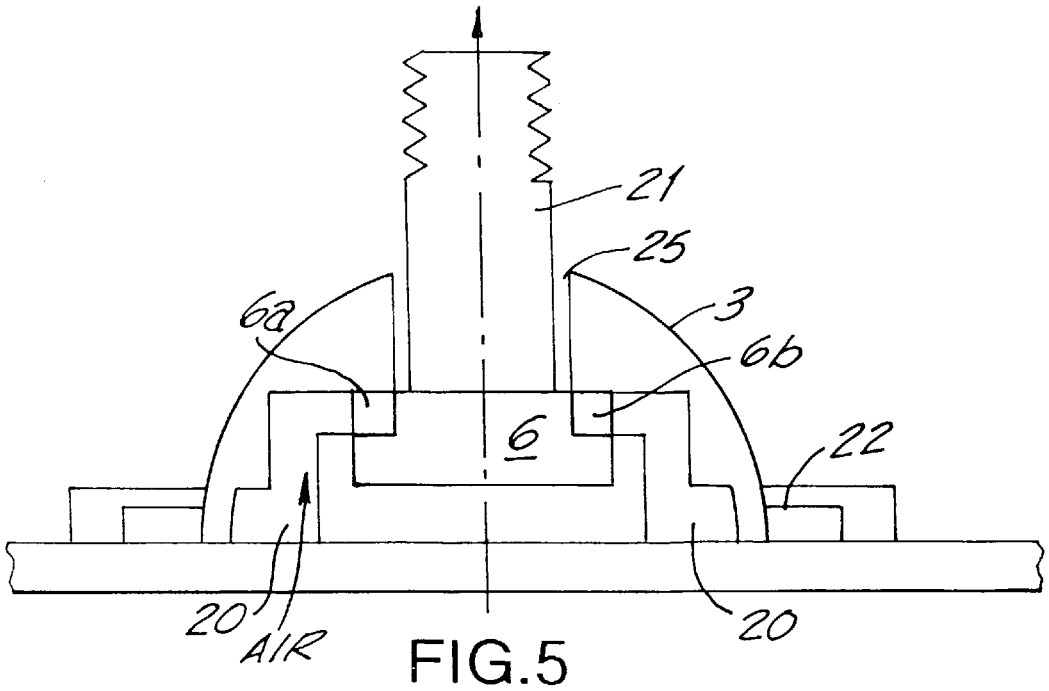
FIG. 5 is a cross section view of another embodiment showing different means for effecting rotational movement but is otherwise the same as the device shown in FIG. 1.
Figure 6:
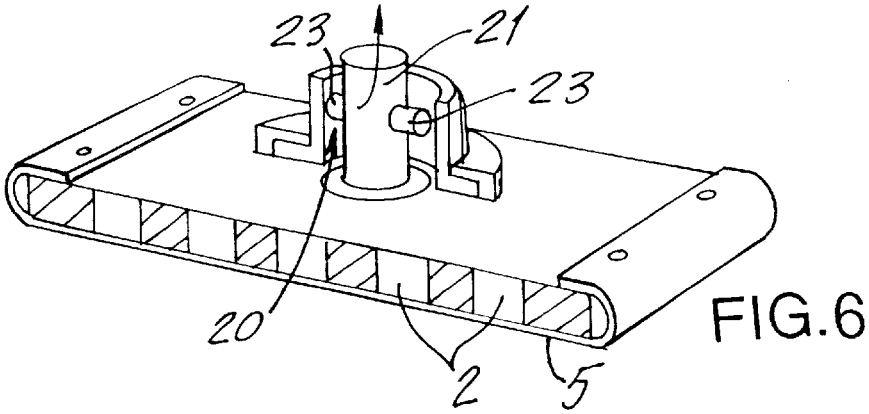
FIG. 6 is an isometric view of FIG. 5, with FIG. 6*a* showing airflow through the hollow hinge in FIG. 6.
Figure 6A:
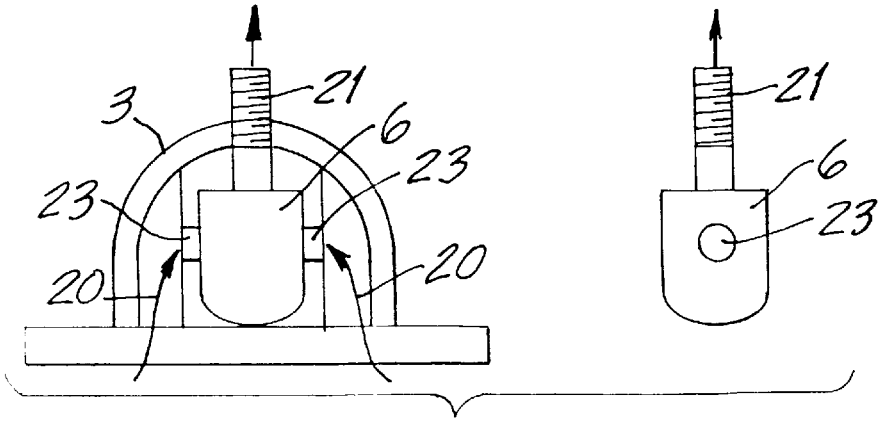
Figure 7:
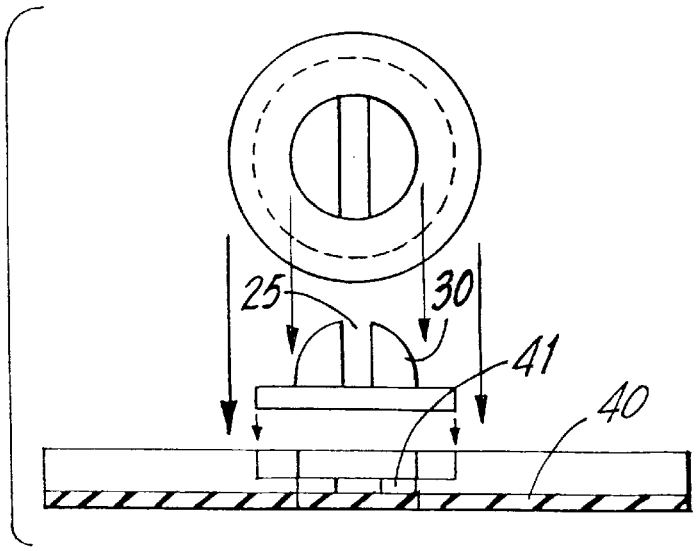
FIG. 7 is an alternative embodiment of the rotatable element section.

As more clearly shown in FIGS. 5 and 6, dome element 3' supports and surrounds the hinge portion 6 to route the vacuum and air/dust flow through conduit 20 which passes through the sanding block and dome 3'. Handle 1 is connected to pipe extension member 21 leading to hinge 6 which is freely hingedly movable in slot 25. Dome member 3*a* is shown in FIG. 1 as being connected to member 3*b* and spaced therefrom by bearings. In FIG. 5, the dome element 3' is unitary and is held down by overlapping flange 22, with the dome element 3' being rotatable against a smooth surface such as of plastic of the sanding block. In another embodiment of hold-down and rotation means shown in FIG. 7, dome element 30 is fitted into a cutout 41 in platform 40 with the dome element 30 being rotatable in place of the separate base swivel element 3*b* of FIG. 1 and the flange of FIG. 5. As more clearly seen in FIG. 6, the hinge engagement elements 23 are shown as positioned within the air/dust routing dome member with FIG. 6*a* showing element 6 from front and side views showing airflow through the open hollow bosses 6*a* and 6*b*.

As shown in FIGS. 8 and 8*a*, in a preferred embodiment, the base of the dome 3 is provided with shallot pits 54, and a separate ring element 50 is inserted between the dome 3 and the sander base plate 2 and affixed to the latter. The ring element 50 comprises pits 52 which are alignable with pits 54 of the dome 3. Each of the pits 52 is provided with a retained ball 51 which is spring loaded with spring members 53 (the rims of pits 52 are slightly crimped to maintain the major portion of the balls 51 with the pits 52). In operation, as shown in FIG. 8, the spring loaded balls cross the parting line 3-2 and thereby prevent relative rotation between the dome 3 with attached handle 10 and the sanding base plate 2. When a different angle of use is desired, the handle and dome are depressed to fully force the base of the shallow pits 54 to press the balls 51 against the springs 53 and into the pits 52 whereby rotation between the dome and the sander base 2 is possible. When the desired position is reached, pressure on the dome is released and the balls return into different pits 54 to lock the dome and handle into a desired position relative to the sanding base.

It is understood that the above description, drawings and preferred embodiment are only illustrative of the present invention and that changes may be made in structure and relative movement of the components of the sanding device without departing from the scope of the present invention as defined in the following claims. Thus the sanding device may be used for other types of sanding purposes such as for sanding wood or metal, particularly with respect to autobody parts for painting, with changes in structure being possible to accommodate such usages.

What is claimed is:

1. A dust free sanding device adapted to be connected to a vacuum source, the device comprising a sanding block element, which supports an apertured sanding material, and a handle, attached to the sanding block element by means of rotating swivel hinge means, said rotating swivel hinge means comprising means which permit handle movement in a 180° plane, normal to the plane of the block element and wherein said rotating swivel hinge means further comprises means which permit variable rotation thereof and the attached handle in a 360° circle, in a plane parallel to the sanding block element; wherein the handle comprises a hollow cored cylinder with open ends, wherein one of the open ends is connected to a vacuum source and the other end is connected to the hinge means, and wherein the device comprises releasable position retaining means between the handle and the sanding block element, the releasable position retaining means comprises spring loaded detente balls positioned across a parting line between the means which permit variable rotation and the sanding block element, which detente balls are movable by compression of the handle, to a position sufficiently out of the parting line to permit said rotation and which balls return to a position across the parting line, whereby they impede unwanted rotation, when the compression is released.

2. The device of claim 1, wherein the sanding block element is apertured at a connection thereof with the swivel hinge means; and wherein the swivel hinge means is centrally apertured in registration with the aperture in the sanding block element.

3. The sanding device of claim 1, wherein the swivel hinge means comprises a circular bearing track having a first track member affixed to the sanding block and a second track member to which the handle is hingedly affixed, wherein the second track member permits variable rotation thereof relative to the first track member whereby the attached handle is movable in a 360° circle, in a plane parallel to the sanding block element.

4. The sanding device of claim 1, wherein the handle comprises a portion of a vacuum line between an external vacuum source and the hinge.

5. The sanding device of claim 1, wherein the swivel hinge means comprises a circular member slidingly rotatable against a surface of the sanding block to which the handle is hingedly affixed, wherein the circular member permits variable rotation thereof relative to the surface of the sanding block whereby the attached handle is movable in a 360° circle, in a plane parallel to the sanding block element.

6. The sanding device of claim 5 wherein the surface of the sanding block comprises a surface contained within a recess in said sanding block.

7. The sanding device of claim 5 wherein said circular member is hingedly connected to the handle via a hinge member and wherein said circular member comprises conduit means for passage of air and dust from the sanding block to the hinge member and wherein the hinge member comprises conduit means for passage of air and dust from the circular member to the handle.

* * * * *